US012108869B2

(12) United States Patent
Paliobeis et al.

(10) Patent No.: US 12,108,869 B2
(45) Date of Patent: Oct. 8, 2024

(54) BEAUTY TOOL HEAD WITH FLEXIBLE BRISTLE BASE

(71) Applicants: Gary Koenemann, El Paso, TX (US); HELEN OF TROY LIMITED, St. Michael (BB)

(72) Inventors: Steven J. Paliobeis, Mentor, OH (US); Jeremy Lee Buttery, El Paso, TX (US); Gary Koenemann, El Paso, TX (US); Ramiro Solis, El Paso, TX (US)

(73) Assignee: HELEN OF TROY LIMITED, St. Michael (BB)

( * ) Notice: Subject to any disclaimer, the term of this patent is extended or adjusted under 35 U.S.C. 154(b) by 350 days.

(21) Appl. No.: 17/595,167

(22) PCT Filed: Jul. 8, 2020

(86) PCT No.: PCT/US2020/041118
§ 371 (c)(1),
(2) Date: Nov. 11, 2021

(87) PCT Pub. No.: WO2021/011247
PCT Pub. Date: Jan. 21, 2021

(65) Prior Publication Data

US 2022/0218095 A1 Jul. 14, 2022

Related U.S. Application Data

(60) Provisional application No. 63/045,973, filed on Jun. 30, 2020, provisional application No. 62/874,143, filed on Jul. 15, 2019.

(51) Int. Cl.

| | |
|---|---|
| ***A45D 1/04*** | (2006.01) |
| ***A46B 9/02*** | (2006.01) |
| ***A46B 15/00*** | (2006.01) |

(52) U.S. Cl.
CPC ..... *A46B 15/003* (2013.01); *A46B 9/023* (2013.01); *A46B 2200/104* (2013.01)

(58) Field of Classification Search
CPC ..... A45D 20/48; A45D 20/52; A46B 15/003; A46B 2200/104
See application file for complete search history.

(56) References Cited

U.S. PATENT DOCUMENTS

| | | | |
|---|---|---|---|
| 1,142,698 | A | 6/1915 | Grove et al. |
| 4,217,915 | A | 8/1980 | Gress et al. |

(Continued)

FOREIGN PATENT DOCUMENTS

| | | |
|---|---|---|
| CN | 102665479 | 9/2012 |
| CN | 107028321 | 8/2017 |

(Continued)

OTHER PUBLICATIONS

International Search Report filed in PCT/US2020/041118 mailed Oct. 23, 2020.

(Continued)

*Primary Examiner* — Rachel R Steitz
(74) *Attorney, Agent, or Firm* — RANKIN, HILL & CLARK LLP

(57) ABSTRACT

A beauty tool includes a handle portion configured to house an associated heating assembly and a bristle portion connected to the handle portion. The bristle portion includes a primary heating element configured to be heated by the associated heating assembly. A bristle base heated member is mounted to an outer periphery of the heating element. The bristle base heated member has a secondary heating element configured to be heated by the primary heating element. A non-conductive, heat insulating bristle spacer is secured between the bristle base heated member and the heating element. A bristle bar is secured by the bristle spacer and has (Continued)

bristles extending through the bristle spacer and the bristle base heated member. The bristle spacer is configured to thermally isolate the bristle bar from both the heating element and the bristle base heated member.

18 Claims, 5 Drawing Sheets

(56) References Cited

U.S. PATENT DOCUMENTS

| | | | |
|---|---|---|---|
| 4,486,915 | A | 12/1984 | Stewart et al. |
| 4,564,032 | A | 6/1986 | Araki |
| 6,618,893 | B1 | 9/2003 | Wang |
| 9,414,661 | B2 | 8/2016 | Keong |
| 2014/0102471 | A1 | 4/2014 | Kaizuka |
| 2014/0332023 | A1 | 11/2014 | Kaizuka |
| 2015/0135455 | A1 | 5/2015 | Reusche et al. |
| 2016/0262518 | A1 | 9/2016 | Guy-Rabi et al. |
| 2017/0112271 | A1* | 4/2017 | Gulamani ..... A46B 15/003 |
| 2018/0103748 | A1 | 4/2018 | Sze |
| 2018/0125223 | A1 | 5/2018 | Exley |

FOREIGN PATENT DOCUMENTS

| | | |
|---|---|---|
| EP | 2962592 | 1/2016 |
| EP | 3240455 | 11/2017 |
| WO | 2015043489 | 4/2015 |

OTHER PUBLICATIONS

Supplemental EP Search Report filed in EP20840195 dated Apr. 21, 2023.

* cited by examiner

BEAUTY TOOL HEAD WITH FLEXIBLE BRISTLE BASE

BACKGROUND

Beauty tools, such as hairbrushes, heating irons, and other styling devices, are conventionally known and commonly used. Conventional hair brushes generally include a handle or other gripping surface, and a brush or bristle end for separating hair as it is run through a user's hair. Curling or heating irons also conventionally have a handle portion, but include a heating area instead of the brush or bristle end. The conventional hair brush and heating iron have also been integrated into a heating hair brush. Typically, the conventional hair brush and heating iron combination tends to have an interior heating surface and conventional brush bristles extending outwardly through the heated portion. When in use, the heat is distributed to the brush bristles to heat the user's hair as the brush is run through a user's hair.

SUMMARY

Exemplary embodiments described herein include a heated beauty tool, such as a heated airbrush. According to the present disclosure, the heated hairbrush may include a handle portion configured to house a heating assembly and a bristle portion. The bristle portion may include one or more heated areas. The heated areas may be integrated or form a part of or all of one or more bristles. The heated hairbrush may include two or more different bristle configurations, including a heated bristle and a non-heated bristle. More particularly, the bristle portion includes a barrel-shaped primary heating element configured to be heated by the heating assembly. The bristle portion includes bristle base heated members interlocked about an outer periphery of the heating element. Each bristle base heated member has one or more secondary heating elements (i.e., heated bristles) configured to be heated by the primary heating element. The bristle portion includes non-conductive, heat insulating bristle spacers secured by the bristle base heated members and the heating element. Bristle bars are secured by the bristle spacers and have one or more bristles (i.e., non-heated bristles) extending through the bristle spacers and the bristle base heated members.

According to one aspect, a beauty tool comprises a handle portion configured to house an associated heating assembly and a bristle portion connected to the handle portion. The bristle portion includes a primary heating element configured to be heated by the associated heating assembly. A bristle base heated member is mounted to an outer periphery of the heating element. The bristle base heated member has a secondary heating element configured to be heated by the primary heating element. A non-conductive, heat insulating bristle spacer is secured between the bristle base heated member and the heating element. A bristle bar is secured by the bristle spacer and has bristles extending through the bristle spacer and the bristle base heated member. The bristle spacer is configured to thermally isolate the bristle bar from both the heating element and the bristle base heated member.

According to another aspect, a beauty tool comprises a handle portion configured to house an associated heating assembly, and a bristle portion connected to the handle portion. The bristle portion includes a barrel-shaped primary heating element configured to be heated by the associated heating assembly. Bristle base heated members are interlocked about an outer periphery of the heating element. Each bristle base heated member has a secondary heating element configured to be heated by the primary heating element. Non-conductive, heat insulating bristle spacers are secured by the bristle base heated members and the heating element. Bristle bars are secured by the bristle spacers and have bristles extending through the bristle spacers and the bristle base heated members.

DETAILED DESCRIPTION

Figure 1:
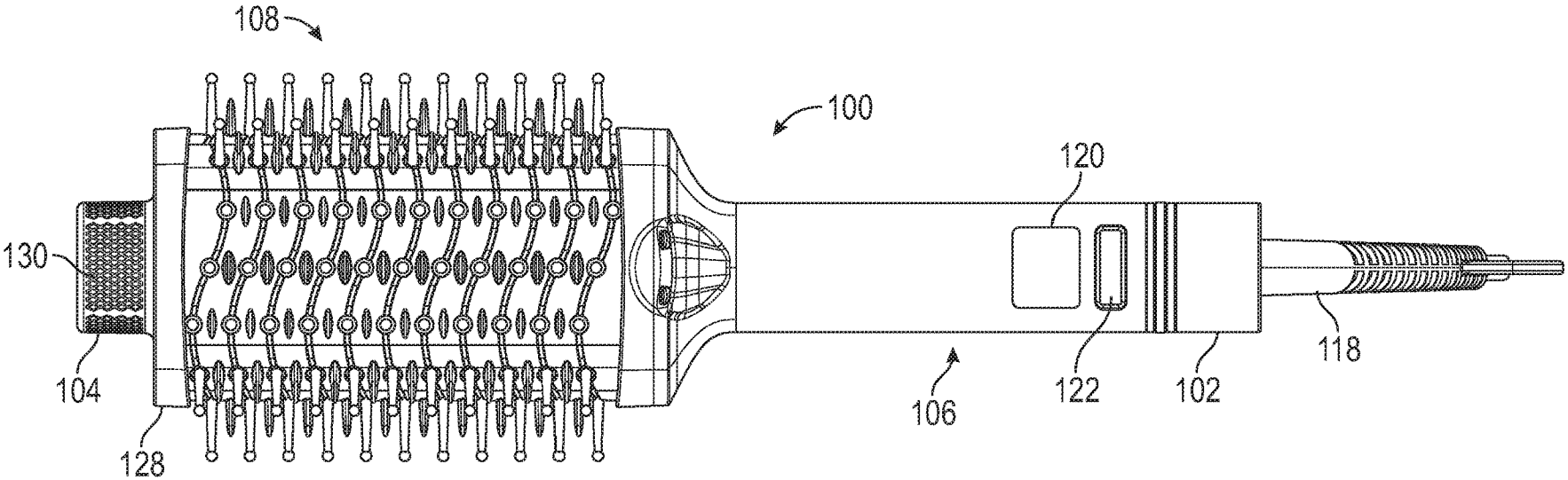
FIG. 1 is a top view of a beauty tool according to the present disclosure, the beauty tool including a handle portion and a bristle portion.
Figure 2:
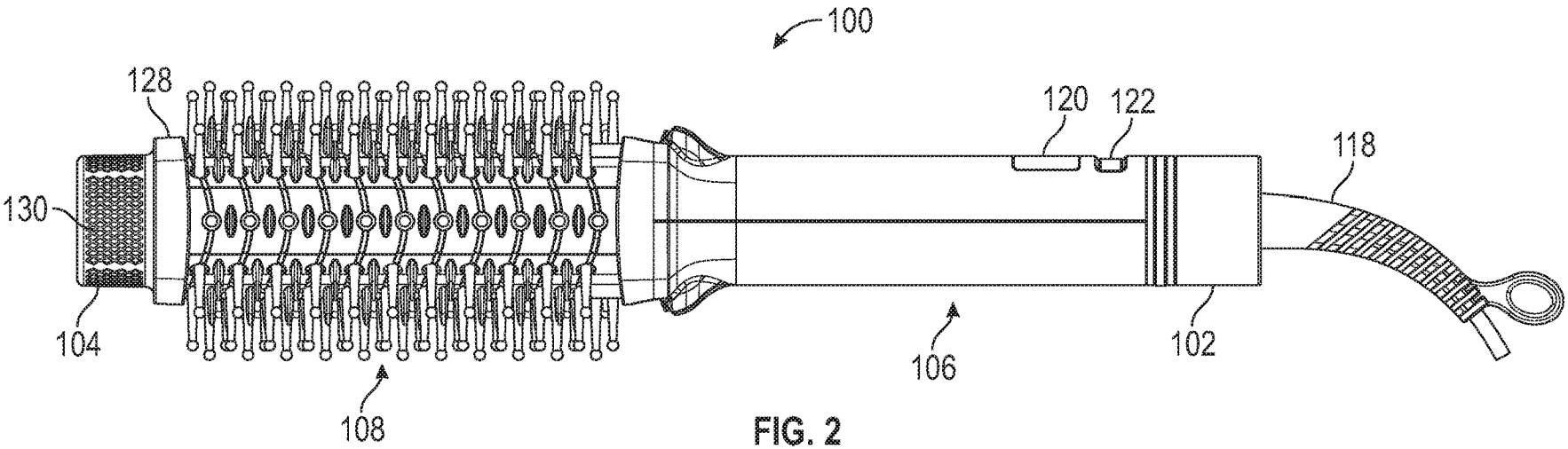
FIG. 2 is a side view of the beauty tool.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIGS. 1 and 2 illustrate a beauty tool, such as the depicted heated hairbrush 100, according to the present disclosure. The heated hairbrush 100 may comprise a first end portion 102, a second end portion 104, a handle portion 106 and a bristle portion 108. The handle portion 106 is located between the first end portion 102 and the bristle portion 108, and the bristle portion is located between the second end portion 104 and the handle portion 106. The handle portion 106 is configured to house a heating assembly (not shown) configured to heat a heating element 116 (FIG. 3) provided in the bristle portion 108. The heater assembly may be any conventional heater assembly which can be incorporated within the hairbrush 100. The heating element 116 can be formed of any type of heat conductive material, such as metal (e.g. aluminum) or ceramic. The hairbrush 100 can be powered by electricity through a cord 118 (only a portion is visible); however, it will be appreciated that the hairbrush 100 can be powered by other means, such as one or more batteries for example. As depicted, the handle portion 106 may further comprise a control 120, for example, a button, switch, slide, knob, etc., for turning on and off the heating of the hairbrush 100 and regulating the output temperature of the heater assembly, and an indicator 122, such as, a slight, scale, number, display, etc., for relaying information, such as the heating level, to a user.

Figure 3:
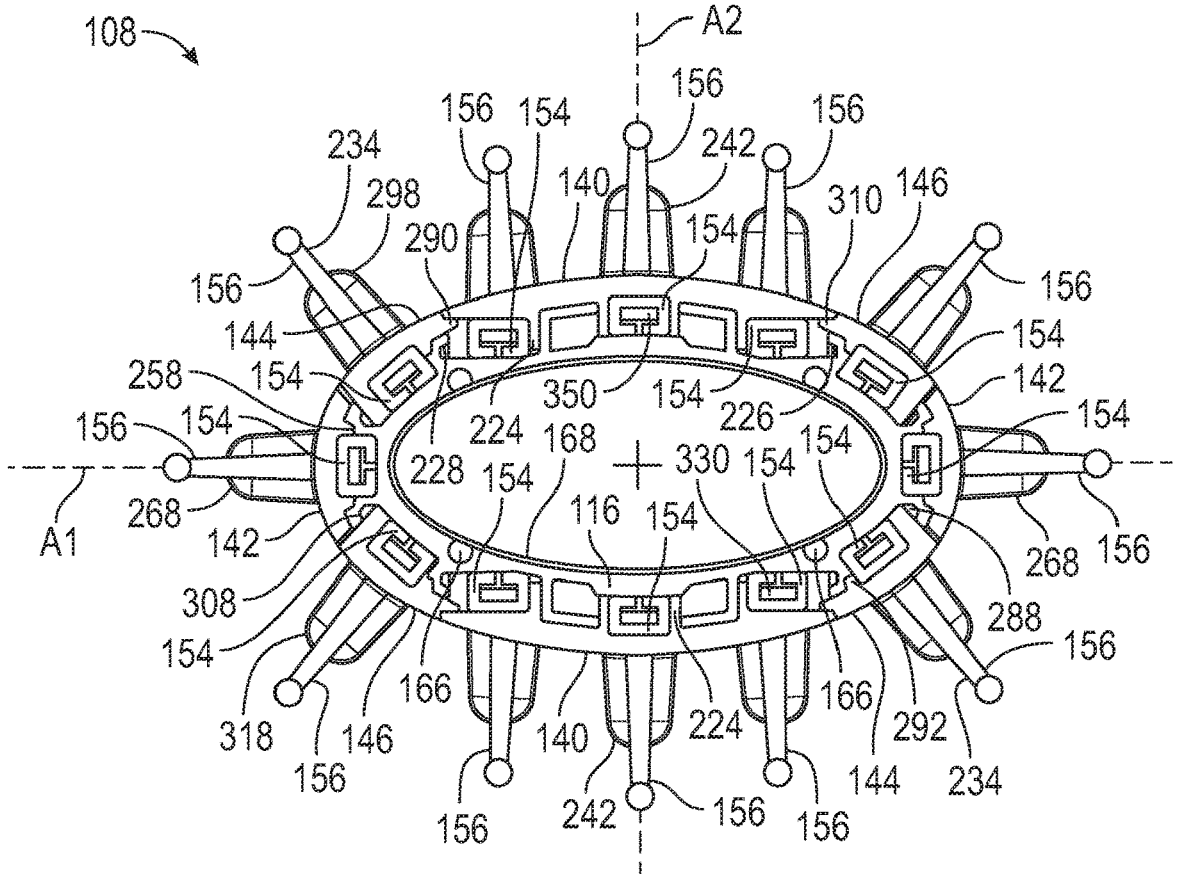
FIG. 3 is an end view of the bristle portion of the beauty tool with an end cap removed.
Figure 4:
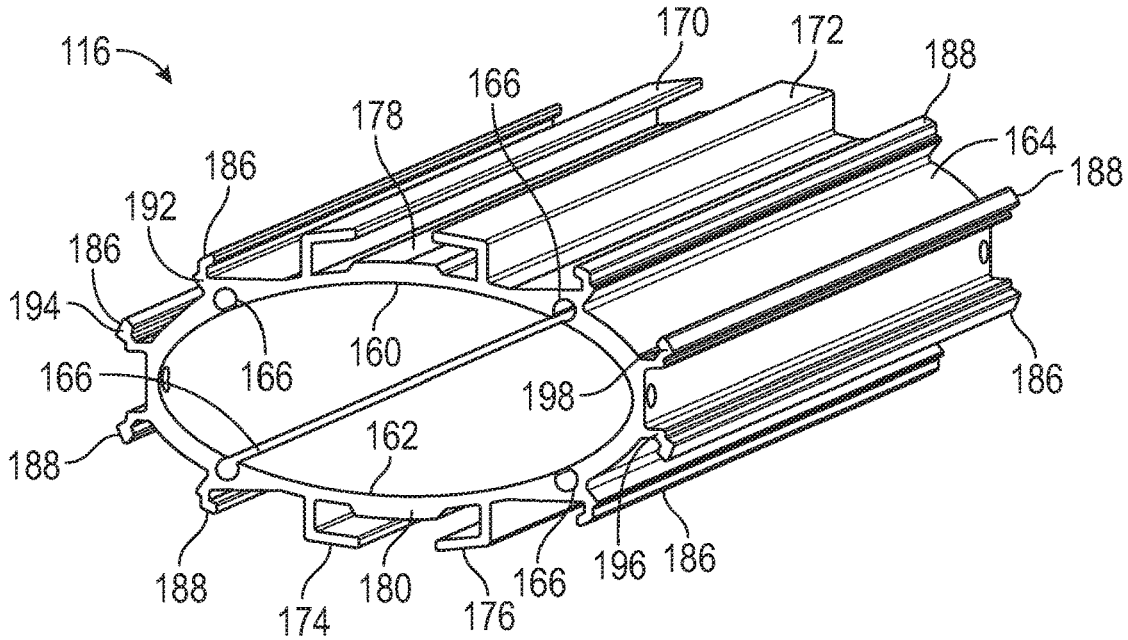
FIG. 4 is a perspective view of a heating element of the bristle portion.

FIG. 3 is an end view of the bristle portion 108 (particularly a view of the second end portion 104 of the hairbrush 100 with the end cap 128 removed). The bristle portion 108 includes the heating element 116, bristle base heated members 140, 142, 144, 146 interlocked about an outer periphery of the heating element, non-conductive, heat insulating bristle spacers 154 secured by the bristle base heated members, and bristle bars 156 secured by the bristle spacers. With reference also to FIG. 4, the heating element 116 can be barrel-shaped and can be elliptical shaped in end view so as to define a major axis A1 and a minor axis A2. The heating element 116 includes a base 160 having an inner surface 162 and an opposite outer surface 164. The inner surface 162 is provided with at least one groove 166 for receiving at least one heating coil (not shown) that is operably connected to the heating assembly housed in the handle portion 106. An inner sleeve 168 corresponding in shape to the inner surface 152 can be press-fitted into the heating element 116 to cover the at least one heating coil located in the at least one groove 166.

The outer surface 164 has extending outwardly therefrom a first pair of circumferentially spaced flanges 170, 172 (i.e., guide flanges) and a second pair of circumferentially spaced flanges 174, 176 (i.e., guide flanges) located opposite the first pair of) flanges 170, 172 along the minor axis A2. The flanges 170, 172, which can be L-shaped, are oriented in a facing relationship and extend along a length of the heating element 116. Similarly, the flanges 174, 176, which can be L-shaped, are oriented in a facing relationship and extend along a length of the heating element 116. As shown, the flanges 170, 172 flank a platform 178 provided on the outer surface 164, and the flanges 174, 176 flank a platform 180 provided on the outer surface 164. Further provided on the heating element 116 are first and second flanges 186, 188 (i.e., mounting flanges). Each of the first flanges 186 includes a first leg 192 extending from the outer surface and a second leg 194 extending obliquely from a side of the first leg. The second flanges 188 include first and second legs 196, 198 and are shaped identical to the first flanges 186 except for a direction of projection of the second legs 198 of the second flanges 188. In the depicted aspect of the heating element 116, a pair of first flanges 186 is circumferentially spaced from each of the flanges 170, 176, and a pair of second flanges 188 is circumferentially spaced from each of the flanges 172, 174. With this arrangement, provided on opposite sides of the outer surface 164 of the heating element 116 along the major axis A1 are immediately adjacent first and second flanges 186, 188.

Figure 5:
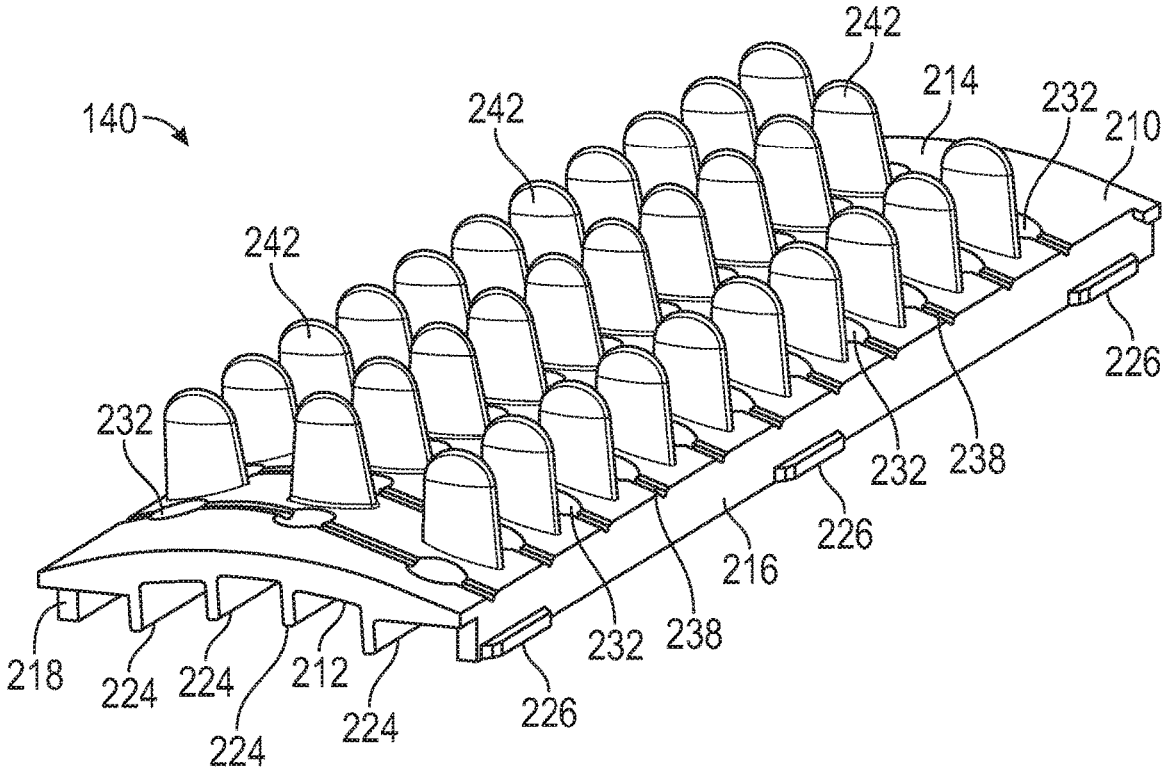
FIG. 5-8 are perspective views of a bristle base heated members of the bristle portion.

In FIG. 3, one of the bristle base heated members 140 is supported by the first pair of flanges 170, 172 and is secured to the heating element by the first and second flanges 186, 188 immediately adjacent the respective flanges 170, 172. The other of the bristle base heated members 140 is supported by the second pair of flanges 174, 176 and is secured to the heating element by the flanges 188, 186 immediately adjacent the respective flanges 174, 176. The features of each of the bristle base heated members 140 are best depicted in FIG. 5. As illustrated, each bristle base heated member 140 includes a base support 210 having an inner surface 212 and an outer surface 214, and sidewalls 216, 218 depending from opposite side edges of the base support 210. The inner surface 212 has depending therefrom spaced tabs 224 which extend along a length direction of the base support. When assembled on the heating element 116, the tabs 224 flank the flanges 170, 172, and the flanges engage the inner surface 212. Each of the sidewalls 216, 218 includes spaced ledges 226, 228 (only ledges 226 on the sidewall 216 are shown in FIG. 5, ledges 228 are visible in FIG. 3). The ledges 226, 228 engage with the second legs 194, 198 of the respective first and second flanges 186, 188 of the heating element 116 (see FIG. 3). The base support 210 further includes a plurality of opening 232 extending therethrough, the openings being aligned in both the length direction and width direction of the base support 210. Each of the openings 232 is sized to receive a non-heated bristle 234 of the bristle bar 156. According to one aspect, the opening 232 aligned in the width direction of the base support 210 are interconnected by grooves 238 formed in the outer surface 214. Further depicted in FIG. 5 is a plurality of substantially arch-shaped heating elements (i.e., heated bristles) 242 integral with and protruding from the outer surface 214. The heating elements 242 are aligned in both the length direction and width direction of the base support 210 in an alternating manner with the openings 232.

Figure 6:
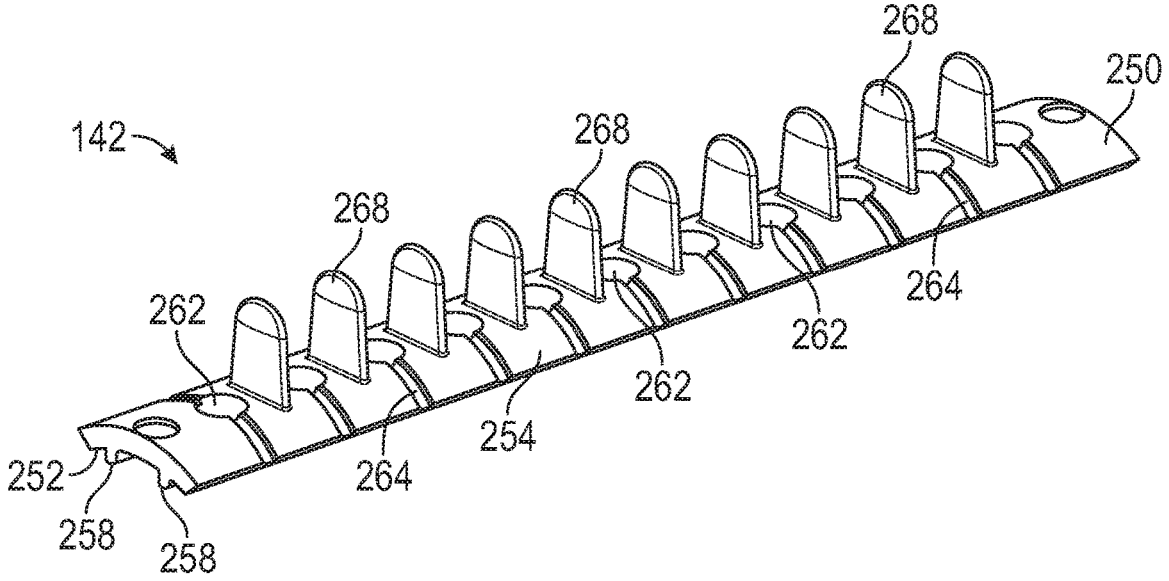

In FIG. 3, the bristle base heated members 142 are provided opposite one another on the heating element 116 and are supported by the immediately adjacent first and second flanges 186, 188 on the opposite sides of the heating element 116 (again along the major axis A1). The features of the bristle base heated members 142 are best depicted in FIG. 6. As illustrated, each bristle base heated member 142 includes a base support 250 having an inner surface 252 and an outer surface 254. The inner surface 252 has depending therefrom spaced tabs 258 which extend along a length direction of the base support 250. Each of the tabs 258 can be grooved along their length to engage with the second legs 194, 198 of the respective first and second flanges 186, 188 of the heating element 116 (see FIG. 3). The base support 250 further includes a plurality of opening 262 extending therethrough, the openings being aligned in a length direction of the base support 250. Each of the openings 262 is sized to receive a bristle 234 of the bristle bar 156. According to one aspect, the opening 262 are intersected by grooves 264 formed in the outer surface 254. Further depicted in FIG. 6 is a plurality of substantially arch-shaped heating elements (i.e., heated bristles) 268 integral with and protruding from the outer surface 254. The heating elements 268 are aligned in the length direction of the base support 210 in an alternating manner with the openings 262.

Figure 7:
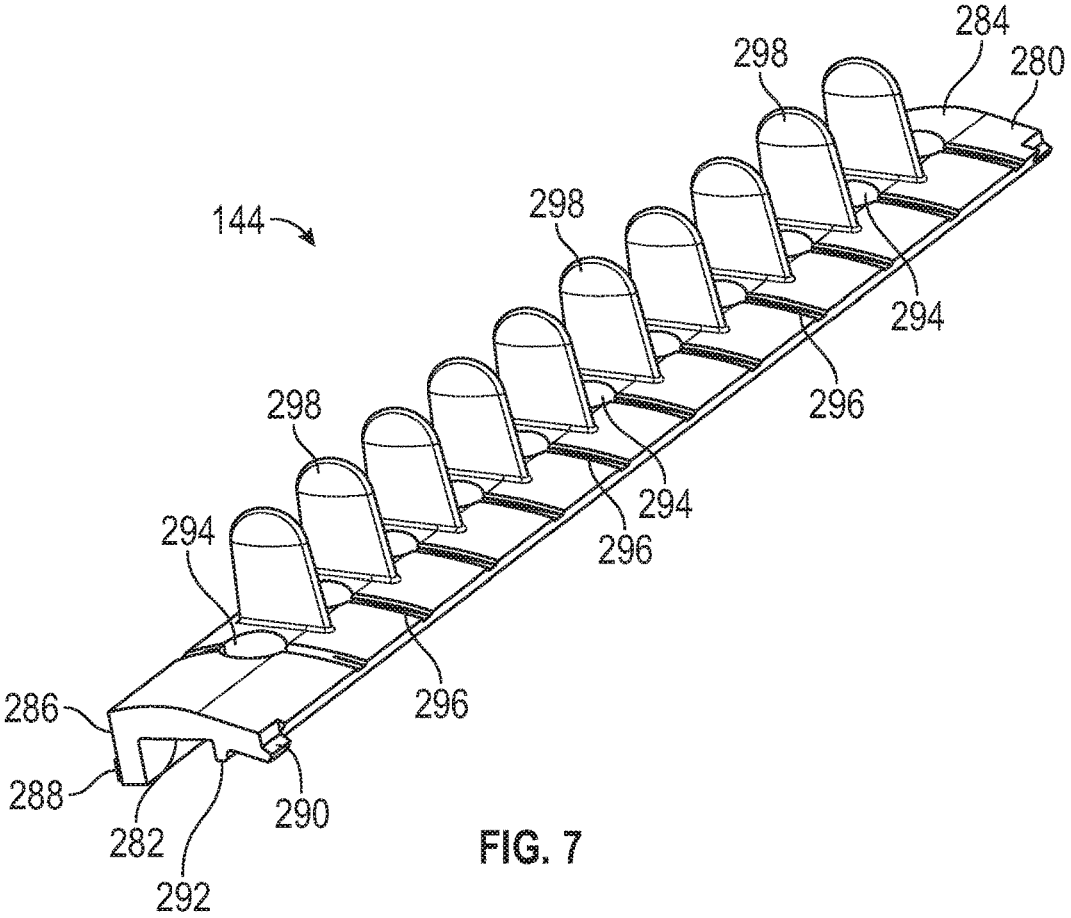
Figure 8:
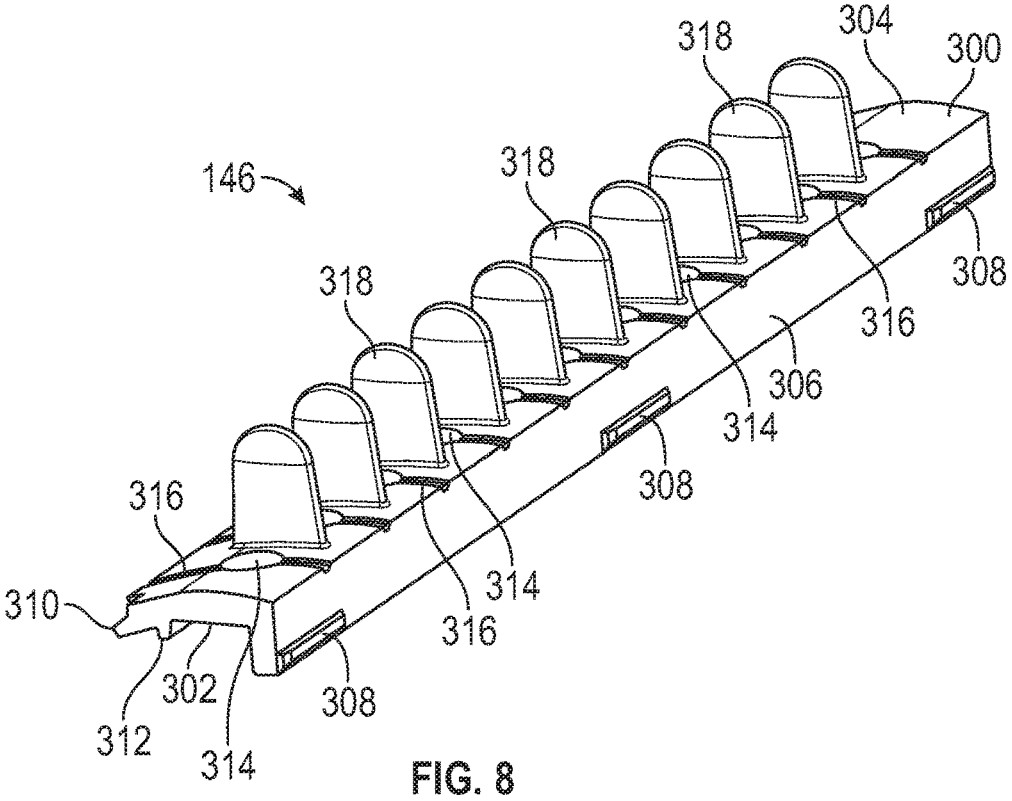

In FIG. 3, the bristle base heated members 144, 146 are identically configured but for their connection along opposite sides of the bristle base heated member 140. The features of the bristle base heated members 144, 146 are best depicted in FIGS. 7 and 8. As illustrated, each bristle base heated member 144, 146 includes a base support 280, 300 having an inner surface 282, 302 and an outer surface 284, 304, and a sidewall 286, 306 depending from a side edge of the base support 280, 300. The sidewall 286, 306 includes spaced ledges 288, 308 which engage with the second legs 194, 198 of the respective first and second flanges 186, 188 of the heating element 116 (see FIG. 3). Further, the opposite side edge of the base support 280, 300 has a recessed portion provided with a projecting lip 290, 310 which engages the inner surface 212 of the base support 210 of bristle base heated member 140 (see FIG. 3). The inner surface 282, 302 has depending therefrom a tab 292, 312 which extend along a length direction of the base support 280, 300. The tab 292 can be grooved along its length to engage with the second leg 194 of the first flange 186 (see FIG. 3), and the tab 312 can be grooved along its length to engage with the second leg 196 of the second flange 188 (see FIG. 3). The base support 280, 300 further includes a plurality of opening 294, 314 extending therethrough, the openings being aligned in a length direction of the base support 280, 300. Each of the openings 294, 314 is sized to receive a bristle 234 of the bristle bar 156. According to one aspect, the openings 294, 314 are intersected by grooves 296, 316 formed in the outer surface 284, 304. Further depicted in FIGS. 7 and 8 are a plurality of substantially arch-shaped heating elements 298, 318 (i.e., heated bristles) integral with and protruding from the outer surface 284, 304. The heating elements 298, 318 are aligned in the length direction of the base support 280, 300 in an alternating manner with the openings 294, 314.

It should be appreciated that the secondary heating elements 242, 268, 298, 318 (i.e., heated bristles), which are heated by the primary heating element 116, define one or more heated hair treating areas of the hairbrush 100 which in accordance with this example is configured to treat the hair with heat and thereby allow its styling, such as straightening or waving. It should also be appreciated that when the bristle base heated members 140, 142, 144, 146 are assembled onto the heating element 116, the grooves 238, 264, 296, 316 become aligned to define continuous grooves about a periphery of the bristle portion 108 which prevent binding of the user's hair as the hairbrush 100 is run through a user's hair.

Figure 9:
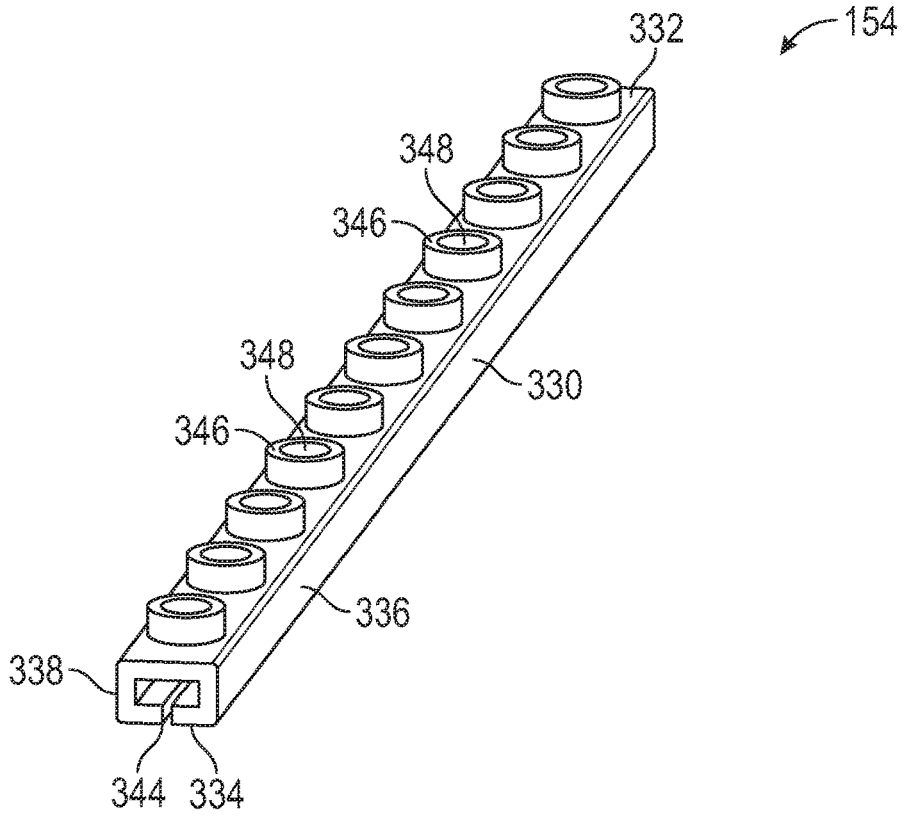
FIG. 9 is a perspective view of a bristle spacer of the bristle portion.
Figure 10:
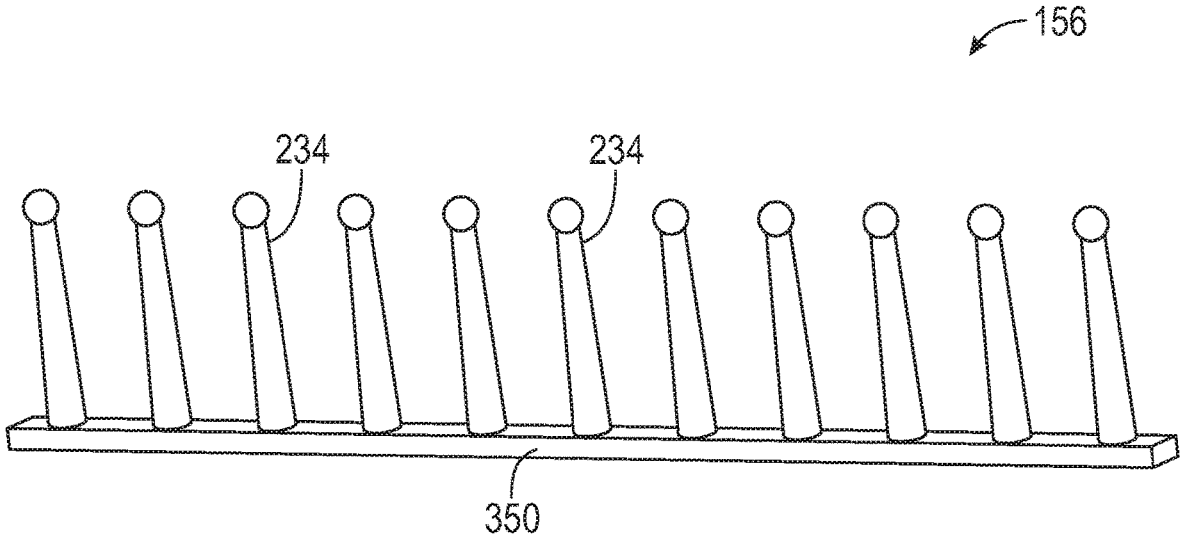
FIG. 10 is a perspective view of a bristle bar of the bristle portion.

FIG. 9 depicts the bristle spacers 154 secured by the bristle base heated members 140, 142, 144, 146, and FIG. 10 depicts the bristle bars 156 secured by the bristle spacers 154. Each bristle spacer 154 includes rectangular shaped base 330 having an upper surface 332 and a lower surface 334 and opposite sides 336, 338. The lower surface 334 is provided with a cutout 344 elongated in a length direction of the base 330. The upper surface 332 is provided with an array of bosses 346 having bores 348 which extend through the upper surface 332. The bosses 346 are preferably molded integrally with the base 330. Each bristle bar 156 includes a base 350 having the non-heated bristles 234 in the form of plastic stubs extending outwardly therefrom. The bristles 234 are preferably molded integrally with the base 350. The cutout 344 provides the manner by which the base 350 is received in the base 330 (see FIG. 3), and when positioned in the base 330 the bristles 234 extend through the bores 348. The bristle spacers 154 are configured to thermally isolate the bristle bars 156 from both the heating element 116 and the bristle base heated members. In FIG. 3, the bristle spacers 154 are sandwiched between the heating element 116 and the bristle base heated members 140, 142, 144, 146, and the bosses 346 are received in the openings 232, 262, 294, 314 of the respective the bristle base heated members 140, 142, 144, 146. More particularly, for the bristle base heated members 140, bristle spacers 154 are secured between each of the sidewalls 216, 218 and adjacent tabs 224, and between the tabs 224 that flank the platforms 178, 180. For the bristle base heated members 142, bristle spacers 154 are secured between the tabs 258. For the bristle base heated members 144, bristle spacers 154 are secured between the sidewalls 286 and the first flanges 186, and for the bristle base heated members 146, bristle spacers 154 are secured between the sidewalls 306 and the second flanges 188. It should be appreciated that the bristle spacers 154 can be made from any non-conductive, heat insulating material, e.g. plastic, rubber, silicone etc. which prevents the heating of the bristle bars 156 by the heating element 116. Further, the bristle spacers 154 can be rigid or at least partially flexible (e.g. the base 330 can be rigid and the bosses 346 received in the openings of the bristle base heated members can be flexible).

Accordingly, exemplary embodiments described herein include a heated beauty tool, such as the depicted hairbrush 100. The heated hairbrush may include a handle portion 106 configured to house a heating assembly and a bristle portion 108. The bristle portion 108 may include one or more heated areas. The heated areas may be integrated or form a part of or all of one or more bristles. The heated hairbrush 100 may include two or more different bristle configurations, including a heated bristle and a non-heated bristle.

According to one aspect, the bristle portion 108 includes a primary heating element 116 configured to be heated by the associated heating assembly. A bristle base heated member is mounted to an outer periphery of the heating element 116. The bristle base heated member has a secondary heating element (i.e., heated bristles) configured to be heated by the primary heating element. A non-conductive, heat insulating bristle spacer 154 is secured between the bristle base heated member and the heating element 116. A bristle bar 156 is secured by the bristle spacer 154 and has bristles extending through the bristle spacer and the bristle base heated member. The bristle spacer 154 is configured to thermally isolate the bristle bar 156 from both the heating element 116 and the bristle base heated member.

Further, the heating element 116 includes at least one guide flange 170, 172 extending outwardly from an outer surface of the heating element 116. The guide flange is adapted to position the bristle base heated member on the heating element. At least one mounting flange 186, 188 also extends outwardly from the outer surface of the heating element 116. The mounting flange is adapted to mount the bristle base heated member on the heating element 116.

More particularly, the bristle portion 108 includes the primary heating element 116 configured to be heated by the heating assembly. The bristle portion 108 includes plural bristle base heated members 140, 142, 144, 146 interlocked about an outer periphery of the heating element. Each bristle base heated member has one or more secondary heating elements 242, 268, 298, 318 (i.e., heated bristles) configured to be heated by the primary heating element. The bristle portion 108 includes the non-conductive, heat insulating bristle spacers 154 secured by the bristle base heated members 140, 142, 144, 146 and the heating element 116, and the bristle bars 156 secured by the bristle spacers 154 and having one or more bristles 234 (i.e., non-heated bristles) extending through the bristle spacers 154 and the bristle base heated members 140, 142, 144, 146.

In the depicted aspect, guide flange 170, 172 extend outwardly from an outer surface of the heating element 116 and are adapted to position the bristle base heated member 140 on the heating element 116. Plural mounting flanges 186, 188 also extend outwardly from the outer surface of the heating element 116. The mounting flanges are adapted to mount the bristle base heated members 140, 142, 144, 146 on the heating element. The mounting flanges include first mounting flanges 186 extended in a first direction from the outer surface of the heating element 116 and second mounting flanges 188 extended in a second opposite direction from the outer surface of the heating element 116.

It will be appreciated that the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the present disclosure.

The invention claimed is:

1. A beauty tool, comprising:

a handle portion configured to house an associated heating assembly; and a bristle portion connected to the handle portion, the bristle portion including:

a primary heating element configured to be heated by the associated heating assembly, a bristle base heated member mounted to an outer periphery of the primary heating element, the bristle base heated member having a secondary heating element configured to be heated by the primary heating element, a non-conductive, heat insulating bristle spacer secured between the bristle base heated member and the primary heating element, and a bristle bar secured by the bristle spacer and having bristles extending through the bristle spacer and the bristle base heated member, wherein the bristle spacer is configured to thermally isolate the bristle bar from both the primary heating element and the bristle base heated member.

2. The beauty tool of claim 1, wherein the primary heating element and the bristle base heated member together define an elongated enclosed passage for receiving the bristle spacer.

3. The beauty tool of claim 1, wherein the primary heating element includes:

at least one guide flange extending outwardly from an outer surface of the primary heating element, the guide flange adapted to position the bristle base heated member on the primary heating element, and at least one mounting flange extending outwardly from the outer surface, the mounting flange adapted to mount the bristle base heated member on the primary heating element.

4. The beauty tool of claim 3, wherein the bristle base heated member has an inner surface defining a channel for receiving the bristle spacer, and a sidewall of the bristle base heated member is configured to engage the mounting flange.

5. The beauty tool of claim 4, wherein the bristle base heated member is a first bristle base heated member, and further including a separate second bristle base heated member and a separate third bristle base heated member, each of the second and third bristle base heated members is mounted to the primary heating element and interlocked with the first bristle base heated member, each of the second and third bristle base heated members has a secondary heating element configured to be heated by the primary heating element.

6. The beauty tool of claim 5, wherein:

the bristle spacer is a first bristle spacer, and further including:

a separate non-conductive, heat insulating second bristle spacer secured between the second bristle base heated member and the primary heating element, and a separate non-conductive, heat insulating third bristle spacer secured between the third bristle base heated member and the primary heating element, and the bristle bar is a first bristle bar, and further including:

a separate second bristle bar secured by the second bristle spacer and having bristles extending through the second bristle spacer and the second bristle base heated member, and a separate third bristle bar secured by the third bristle spacer and having bristles extending through the third bristle spacer and the third bristle base heated member, wherein the second bristle spacer is configured to thermally isolate the second bristle bar from both the primary heating element and the second bristle base heated member, and wherein the third bristle spacer is configured to thermally isolate the third bristle bar from both the primary heating element and the third bristle base heated member.

7. The beauty tool of claim 5, wherein plural mounting flanges extend outwardly from the outer surface of the primary heating element, the mounting flanges adapted to mount the bristle base heated members on the primary heating element.

8. The beauty tool of claim 7, wherein the mounting flanges include first mounting flanges extended in a first direction from the outer surface of the primary heating element and second mounting flanges extended in a second opposite direction from the outer surface.

9. A beauty tool, comprising:

a handle portion configured to house an associated heating assembly; and a bristle portion connected to the handle portion, the bristle portion including:

a barrel-shaped primary heating element configured to be heated by the associated heating assembly, bristle base heated members interlocked about an outer periphery of the primary heating element, each bristle base heated member having a secondary heating element configured to be heated by the primary heating element, non-conductive, heat insulating bristle spacers secured by the bristle base heated members and the primary heating element, and bristle bars secured by the bristle spacers and having bristles extending through the bristle spacers and the bristle base heated members.

10. The beauty tool of claim 9, wherein the primary heating element includes:

guide flanges extending outwardly from an outer surface of the primary heating element, the guide flanges adapted to position at least one of the bristle base heated members on the primary heating element, and mounting flanges extending outwardly from the outer surface, the mounting flanges adapted to secure the at least one bristle base heated member on the primary heating element.

11. The beauty tool of claim 10, wherein the bristle base heated members include a first bristle base heated member having an inner surface defining separate channels for receiving the guide flanges and one of the bristle spacers, and opposite sidewalls of the first bristle base heated member are configured to engage the mounting flanges.

12. The beauty tool of claim 11, wherein the bristle base heated members include second bristle base heated members, and the mounting flanges are adapted to secure the second bristle base heated members on the primary heating element, the second bristle base heated members located opposite one another relative to a longitudinal axis of the primary heating element.

13. The beauty tool of claim 12, wherein the bristle base heated members include third bristle base heated members, and the mounting flanges are adapted to secure the third bristle base heated members on the primary heating element, the third bristle base heated members are interposed between the first bristle base heated member and the second bristle base heated members.

14. The beauty tool of claim 13, further including a pair of first bristle base heated members located opposite one another relative to the longitudinal axis of the primary heating element.

15. The beauty tool of claim 14, wherein the guide flanges for the first bristle base heated members include a first pair guide flanges oriented in a facing relationship and extended along a length of the primary heating element, and a second pair guide flanges oriented in a facing relationship and extended along a length of the primary heating element, the second pair of guide flanges located opposite the first pair of guide flanges relative to the longitudinal axis of the primary heating element.

16. The beauty tool of claim 13, wherein the mounting flanges include first mounting flanges extended in a first direction from the outer surface of the primary heating element and second mounting flanges extended in a second opposite direction from the outer surface.

17. The beauty tool of claim 16, wherein one of the first mounting flanges and one of the second mounting flanges secure the first bristle base heated member on the primary heating element, and wherein another one of the first mounting flanges and another one of the second mounting flanges secure one of the second bristle base heated members on the primary heating element.

18. The beauty tool of claim 9, wherein the bristle spacers are configured to thermally isolate the bristle bars from both the primary heating element and the bristle base heated members.

* * * * *